United States Patent [19]

Aikman

[11] 4,446,877

[45] May 8, 1984

[54] CIGARETTE HOLDER WITH FILTERING ACTION

[76] Inventor: Leslie N. Aikman, 3628 Ocean Blvd., Corona Del Mar, Calif. 92625

[21] Appl. No.: 308,464

[22] Filed: Oct. 5, 1981

[51] Int. Cl.[3] ..... A24F 5/04; A24D 3/04

[52] U.S. Cl. ..... 131/198 R; 131/336

[58] Field of Search ..... 131/198 R, 198 A, 336, 131/339, 340, 187

[56] References Cited

U.S. PATENT DOCUMENTS

| | | | |
|---|---|---|---|
| 3,323,525 | 6/1967 | Miller | 131/198 R X |
| 3,636,960 | 1/1972 | Blount et al. | 131/210 X |
| 4,344,444 | 8/1982 | Miura | 131/210 X |

*Primary Examiner*—V. Millin
*Assistant Examiner*—Christine A. Fukushima
*Attorney, Agent, or Firm*—Grover A. Frater

[57] ABSTRACT

A tubular cigarette holder has a perforated barrier extending across its interior between the upstream cigarette receiving end of the tube and the downstream or outlet end. Ambient air is introduced in parallel with cigarette smoke through a passageway formed as one or more grooves in the inner wall of the tube at the cigarette receiving end. A rib formed on the inner wall in parallel with the groove indents the wall of the cigarettes to prevent cigarettes from entering and blocking the grooves. A tar collector depends from the barrier such that it will function to collect tar.

1 Claim, 4 Drawing Figures

CIGARETTE HOLDER WITH FILTERING ACTION

TECHNICAL FIELD

This invention relates to improvements in cigarette holders of the kind which remove tar and nicotine products from cigarette smoke.

BACKGROUND ART

Previous cigarette holders have been tubular in form and arranged with an outlet end to be held in the smoker's mouth and a cigarette end in which the end of a cigarette end can be inserted. Some of the previous holders have incorporated filter structures designed to remove tar and nicotine constituents from the smoke as it passes through the holder. The most successful of these filter structures have included a barrier wall which extends across the interior of the filter and is provided with one or more smoke accelerating openings. The patent literature also discloses use of ambient air inlets in the form of a perforation in the side wall of the holder, usually upstream from the barrier, for admitting ambient air into the smoke stream as it passes through the holder.

DISCLOSURE OF INVENTION

The invention improves the filtering action of such tubular holders and makes them easier and less expensive to produce. The interior wall of the holder upstream from the collection means, at the cigarette holder end, is grooved to form one or more air passages for ambient air past the cigarette when inserted. The provision of the groove makes it unnecessary to perforate the side wall of the holder to form an air opening. A rib prevents blockage of the air passage by the cigarette wall.

To further improve the filtering action, the preferred form of the invention includes a barrier wall and adds a tar collector downstream from the barrier in the outlet end. The barrier is given some irregular shape, at least lengthwise of the tube, to promote turbulence in the smoke and air that has passed through the acceleration opening of the barrier. In the preferred form of the invention the tar collector depends from the central portion of the barrier, and the acceleration openings (or single opening) are formed in the barrier away from the center so that the smoke and air enters the outlet end between the tar collector and the inner wall of the holder.

DESCRIPTION OF THE PREFERRED EMBODIMENT

Figure 1:
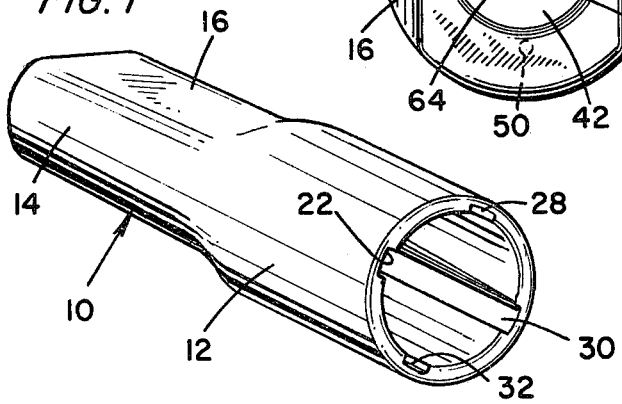
FIG. 1 is an isometric view of a holder in which the invention is embodied.

The preferred form of the invention is shown in the holder 10 of FIG. 1 to be tubular in shape. The upstream or cigarette receiving end 12 is cylindrical. The downstream or outlet end 14 is generally elliptical in cross-section. More accurately, it is cylindrical except that diametric portions of the wall have been formed flat and parallel. That shape forms a mouthpiece which the user can hold between his lips more easily. The flat portions have been numbered 16 and 18, respectively, for identification.

The inner wall 24 of the upstream, cigarette receiving section is cylindrical except that it is grooved at spaced points around its surface and except that inwardly projecting ribs are formed in parallel with the grooves. While other numbers of grooves and ribs may be used, this preferred embodiment includes four grooves and four ribs—one on either side of each groove. The grooves are shaped like channels. The ribs are V-shaped and are tapered to greater transverse cross-sectional area in the downstream direction. One of the grooves, 22, and a rib 34, are quite visible in FIG. 1.

Figure 2:
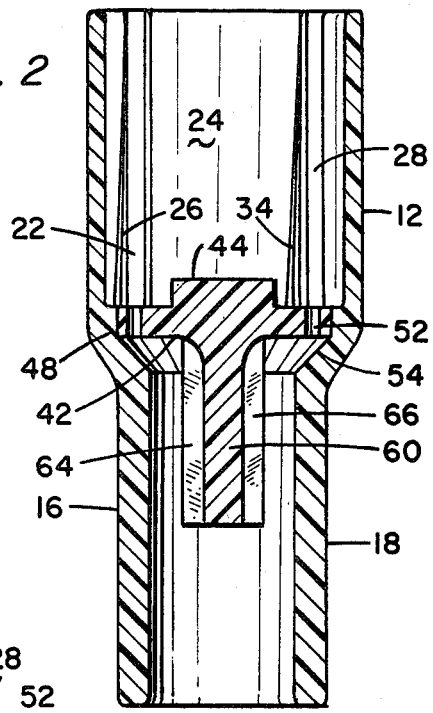
FIG. 2 is a longitudinal cross-sectional view taken on line 2—2 of FIG. 3.
Figure 3:
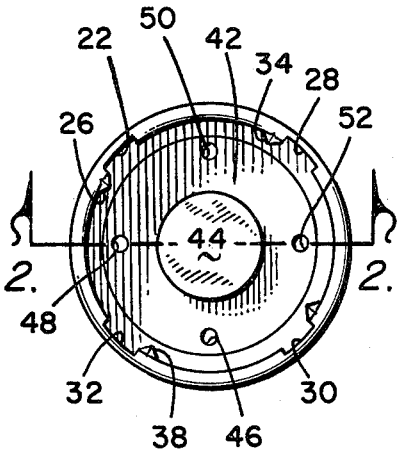
FIG. 3 is an elevational view looking into the cigarette holder end of the holder.
Figure 4:
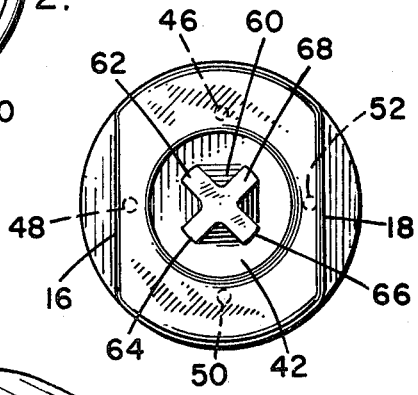
FIG. 4 is an elevational view looking into the outlet end of the holder.

All of the grooves and ribs are visible in FIG. 3. The other grooves are numbered 28, 30 and 32, respectively. Rib 34 is formed at the side of groove 28. Rib 38 is formed at the side of groove 32. The tapered shape of the ribs is illustrated in FIG. 2 and can be understood by comparing FIGS. 2 and 3. They serve to indent the outer, paper wall of any cigarette that is inserted into the holder. The wall is indented inwardly away from the groove. The grooves have uniform width and depth throughout the length. They extend from the upstream rim of the holder back to the barrier 42. The barrier is a wall which extends across the interior of the holder between the upstream and downstream ends. A cylindrical boss 44 extends upstream from the center of the barrier. It serves as a stop to limit the degree of cigarette insertion. The result is that a mixing chamber is formed between the upstream face of the barrier and the cigarette end. The grooves open to this chamber where air and smoke will be mixed when drawn into the chamber as the smoker inhales at the outlet end of the holder.

The barrier 42 is perforated with one or more small openings. This preferred form includes four openings numbered 46, 48, 50 and 52. Because they are very small, the air and smoke are accelerated greatly as they flow through the holes. On reaching the downstream side of the barrier the mixture strikes the sloping inner wall 54 of the holder just downstream from the barrier wall. It expands, slows, and is cooled. Tar and nicotine products condense and a large portion of them engage the walls of the holder and side walls of the tar collector 60 which depends from the barrier into the outlet end of the holder.

The barrier 42 and its projection 44 and the tar collector 60 are formed as one piece, separately from the remainder of the holder. The lower periphery of the barrier wall rests on the upper margin of the inwardly sloping inner wall section 54 of the holder. The accelerating openings are positioned so that air and smoke passing through the accelerating openings impact the sloping surface.

In this embodiment the tar collector extends along the longitudinal axis of the holder. Its sides are indented to form four flutes 62, 64, 66 and 68. The fluted shape increases the surface area on which condensed tars can collect.

Although I have shown and described certain specific embodiments of my invention, I am fully aware that many modifications thereof are possible. My invention, therefore, is not to be restricted except insofar as is necessitated by the prior art.

I claim:

1. A filter for cigarette smoke in the form of a cigarette holder having a cigarette holding end and an outlet end and a collecting means for collecting tar and nicotine products within the holder intermediate said ends, characterized in that at least one air passageway is formed in the interior wall of the holder at the cigarette holding end which is capable of conducting air past a cigarette to the collecting means when the cigarette is held in said cigarette holding end;

at least one rib being formed on the interior wall of the holder in parallel with said air passageway which is capable of indenting the outer wall of a cigarette, when held in the cigarette end of the holder, and preventing closure of the air passageway by the cigarette; and further including a barrier wall in the midregion of the holder and a tar collector extending from said barrier into said outlet end of the holder, and an accelerating opening formed through said barrier which opens to the space between the tar collector and the interior wall of said outlet end of the holder.

* * * * *